US005253368A

United States Patent [19]

Blake

[11] Patent Number: 5,253,368

[45] Date of Patent: Oct. 19, 1993

[54] CAP WITH ERASABLE BILLBOARD

[76] Inventor: David A. Blake, 207 W. Ohio St., #3-R, Chicago, Ill. 60610

[21] Appl. No.: 918,464

[22] Filed: Jul. 22, 1992

[51] Int. Cl.[5] ..... A42B 1/24

[52] U.S. Cl. ..... 2/209.13; 2/195.1; 2/918; 40/329

[58] Field of Search ..... 2/199, 195, 175, 185 R, 2/244, DIG. 6, 209.1, 197, 200; 40/329, 586, 905, 5; 446/26, 28; 224/181, 182; 24/10 R, 11 CC, 11 CT; 15/424, 426

[56] References Cited

U.S. PATENT DOCUMENTS

| | | | |
|---|---|---|---|
| 448,266 | 3/1891 | Schneider | 40/329 |
| 743,399 | 11/1903 | Seebold et al. | 224/181 |
| 792,533 | 6/1905 | Miller | 40/329 |
| 799,997 | 9/1905 | MacLellan | 40/329 |
| 847,809 | 3/1907 | Ollard | 2/185 R |
| 867,794 | 10/1907 | Clark | 40/329 |
| 982,534 | 1/1911 | Rottger, Jr. | 40/329 |
| 1,163,054 | 12/1915 | Williams | 40/329 |
| 1,294,595 | 2/1919 | Allen | 40/329 |
| 1,723,276 | 8/1929 | Gottlieb | 224/5 |
| 2,578,112 | 12/1951 | Vaughn | 40/329 |
| 2,744,256 | 5/1956 | Slotkin et al. | 2/195 |
| 3,346,153 | 10/1967 | Galasso | 2/199 |
| 3,370,818 | 2/1968 | Perr | 24/10 R |
| 3,387,341 | 6/1968 | Mates et al. | 24/10 R |
| 3,466,774 | 9/1969 | Borresen | 24/10 R |
| 3,470,639 | 10/1969 | Ihling | 40/586 |
| 3,895,797 | 7/1975 | Moore | 224/181 |
| 4,472,837 | 9/1984 | Saxton | 2/195 |
| 4,611,355 | 9/1986 | Galanto et al. | 2/246 |
| 4,627,110 | 12/1986 | Tengs | 2/115 |
| 4,710,981 | 12/1987 | Sanchez | 40/586 |
| 4,776,043 | 10/1988 | Coleman | 2/199 |
| 4,924,613 | 5/1990 | Levin | 40/586 |
| 4,985,935 | 1/1991 | Hur | 2/209.1 |
| 5,003,640 | 4/1991 | Pizzacar | 2/199 |
| 5,066,154 | 11/1991 | Renaud | 24/10 R |
| 5,070,545 | 12/1991 | Tapia | 2/195 |

FOREIGN PATENT DOCUMENTS

| | | | |
|---|---|---|---|
| 238852 | 1/1960 | Australia | 40/586 |
| 206334 | 11/1923 | United Kingdom | 224/182 |

OTHER PUBLICATIONS

Hat Clip Holder—"Dotty" *The Washington Post,* May 11, 1948, p. 14B.

Gershman, Maurice, "Self Adhering Nylon Tapes", *Journal of AMA,* vol. 168, No. 7, Oct. 18, 1958.

*Primary Examiner*—Clifford D. Crowder
*Assistant Examiner*—Amy B. Vanatta
*Attorney, Agent, or Firm*—Welsh & Katz, Ltd.

[57] ABSTRACT

A cap having a writing surface attached to its crown. The writing surface is configured to erasably receive writing inscribed thereon by the wearer. There is also included at least one writing implement for inscribing the desired expression or design on the writing surface. The writing implement is removably attached to one of the sides of the cap. The cap also has an eraser for erasing the message from the writing surface when it is desired to partially or completely change the message being communicated. The eraser is also removably attached to one of the sides of the cap.

6 Claims, 4 Drawing Sheets

CAP WITH ERASABLE BILLBOARD

The present invention relates generally to caps, and more specifically, to a cap having an erasable writing surface upon which a user can inscribe a desired message with writing implements that are stored on the cap, and which the user can subsequently completely or partially remove with an eraser that is also attached to the cap.

BACKGROUND OF THE INVENTION

Caps, particularly baseball type caps, have become increasingly popular over the years with both youths and adults. These caps are often decorated with printed or embroidered names, logos, phrases or anything directed at communicating some message by the wearer of the cap. These caps have become popular because of their extreme versatility, numerous styles and configurations, adjustability, and relative inexpensiveness. Such caps are further popularized because professional athletes and entertainers regularly wear caps that are adorned with the names, logos, and other symbols that their fans identify them with.

The caps have also become quite popular as gifts and souvenirs of events, places or things. Collecting the caps has also become a popular hobby. There are caps that come with lights, caps that come with moving parts, caps that talk, caps with radios, caps that carry food or beverages. Caps have also become increasingly popular as a means of communicating a given philosophy, a favorite vacation spot, or an ethnic affiliation. The list goes on and on.

Although consumers can find almost any desirable message on such caps, they are typically forced to purchase preprinted, mass produced caps that cannot be easily adapted to communicate the individual's own specific idea adapted to communicate the individual's own specific idea or message. The consumer is then limited to accepting the idea or message someone has already formed on the cap. If the consumer wishes to profess a unique or temporary thought or idea, the consumer must expend considerable time, effort and money to have a specific cap custom made. Currently known and available caps thus limit the wearer's ability to communicate and express a particular message or to change the message as times or once popular items change. Further, what typically happens is that the once revered team, the once beloved entertainer, or the once popular philosophy falls from fashion and the wearer's desire to profess it publicly When this occurs, the consumer may decide to retire the cap to the shelf in the closet, use it as a temporary painter's cap, or just throw it away.

Thus, there is a need for a cap which can be easily personalized by the wearer to communicate a desired idea or message. Further, there is a need to provide a cap which can be written upon and which allows the wearer to easily remove or change the message communicated by the cap.

Accordingly, it is an object of the present invention to provide a cap on which the user can easily inscribe their personalized idea or message.

Another object of the present invention is to provide a cap with a billboard or writing surface upon which the wearer can removably inscribe a desired message and subsequently remove, alter or completely change the message being communicated.

Yet another object of the present invention is to provide a cap which includes a writing surface and also includes writing implements and an eraser attached directly change the desired message communicated.

Other features and advantages of the present cap with erasable billboard will become apparent upon review of the following detail description, claims and drawings.

DETAILED DESCRIPTION OF THE INVENTION

In accordance with the present invention, all of these objects, as well as others not herein specifically identified, are achieved generally by the present cap with erasable billboard. Broadly stated, the present cap includes a crown portion which consists of a front panel, a rear panel, and side panels. The cap includes a writing surface or billboard that is permanently or removably attached to the crown. The writing surface is configured to erasably receive writing inscribed thereon by the wearer. There is also included at least one writing implement for inscribing the desired expression or design on the writing surface. The writing implement is removably attached to one of the sides of the cap. The cap also has an eraser for erasing the message from the writing surface when it is desired to partially or completely change the message being communicated. The eraser is also removably attached to one of the sides of the cap. The individual components of the present cap can be varied in size, shape and style to match the specific requirements of the manufacturer.

Figure 2:
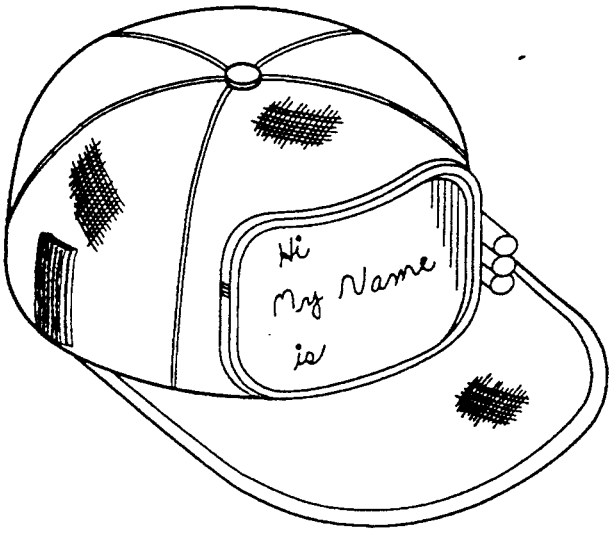
FIG. 2 depicts another side perspective view of the present cap showing the eraser also attached to the cap and the message of FIG. 1 being partially erased.
Figure 3:
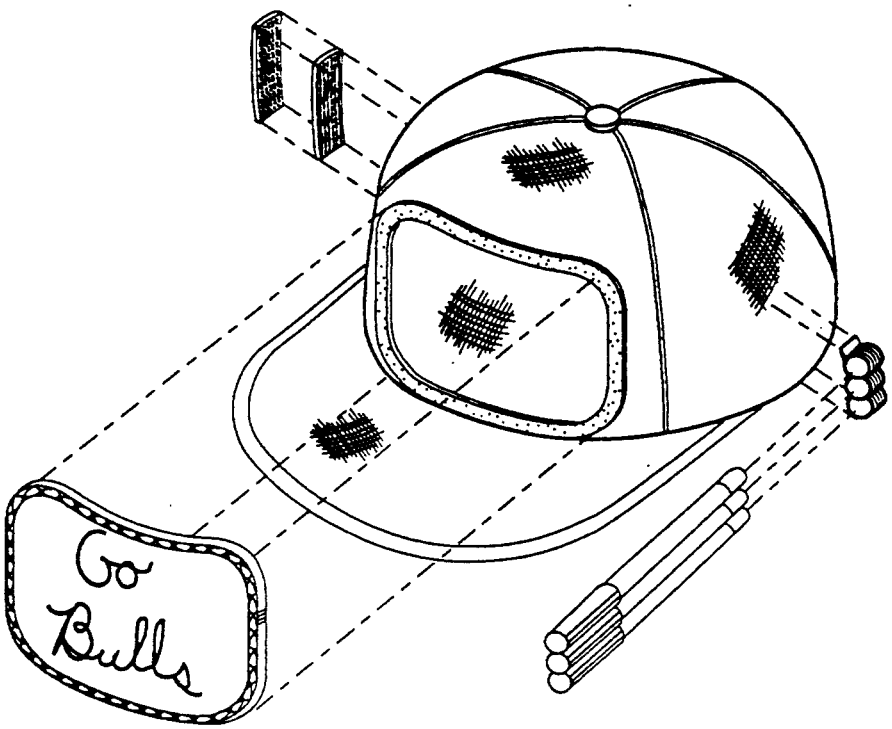
FIG. 3 depicts an exploded view of the present cap and alternative features of the erasable billboard.

The present cap with erasable billboard is shown in FIGS. 2 and 3, and is designated generally at 10. The cap 10 consists of a crown portion 22 and a visor portion 24. The cap 10 is preferably an ordinary baseball type cap having a generally circular crown 22. However, it is anticipated that any type of cap, hat or visor can be used without departing from the principal set out herein. The visor 24 includes a substantially arcuate brim 26 which extends outwards from the crown portion 22 to provide the wearer with shade and to protect the wearer's eyes from exposure to direct light. Both the crown 22 and the visor 24 may be made of fabric, plastic, or other appropriate materials. The crown 22 and visor 24 may be colored and may include screen-printed, impressed or embroidered markings that constitute a phrase, design or other art work.

Typically, the crown 22 of the typical cap 10 will consist of multiple panels that are secured together to form an interior surface 28 and an exterior surface 30. As shown in the several figures, the cap 10 has a front panel 32, side panels 34 and 36 and rear panels 38 and 40. Many other cap configurations exist, including caps that completely are unitary without separate panels or caps that are square, triangular or that embody other unique configurations or shapes. A crown tip 42 may be included on the top of cap 10 for aesthetic reasons.

Figure 4:
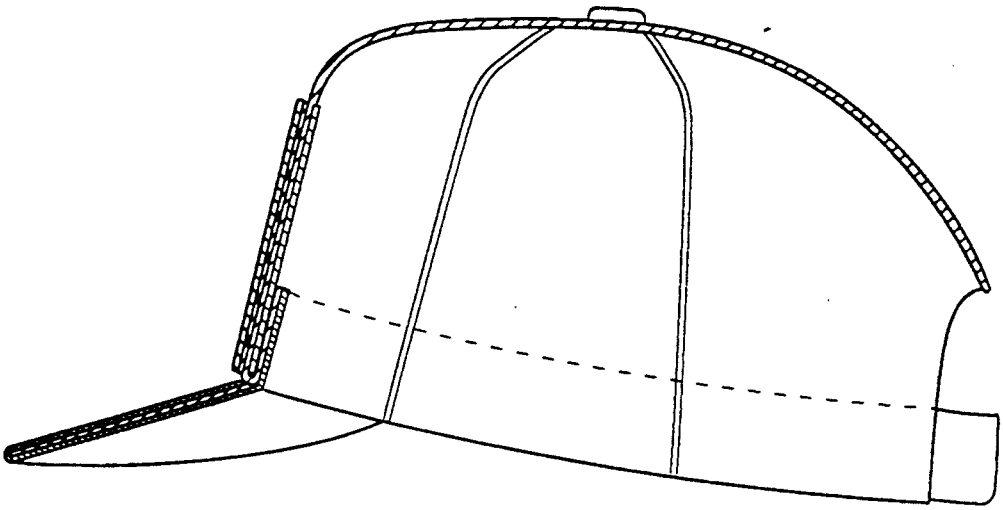
FIG. 4 depicts a side cross-sectional view of the present cap.

Shown best in FIG. 4, in a side cross-sectional view of the cap 10, are the various panels and layers that combine to form the cap 10. A reinforcing layer 44 may be included to provide some rigidity to the front panel 32. Likewise, a sweatband or strip of absorbent material may be included on the interior surface 28 of the crown 24 to absorb perspiration from the wearer's head. The visor 24 is secured along the front panel 32 and typically includes a rigid plastic or cardboard core 46 that is also used to secure the visor 24 to the interior surface 28 of the crown 22. A guide band 48 may also be included to facilitate application and removal of the cap 10 to the wearer's head. The guide band 48 may be adjustable, such as by using a system of hook and loop fasteners, such as Velcro® material, snaps or other common types of fasteners.

Figure 7:
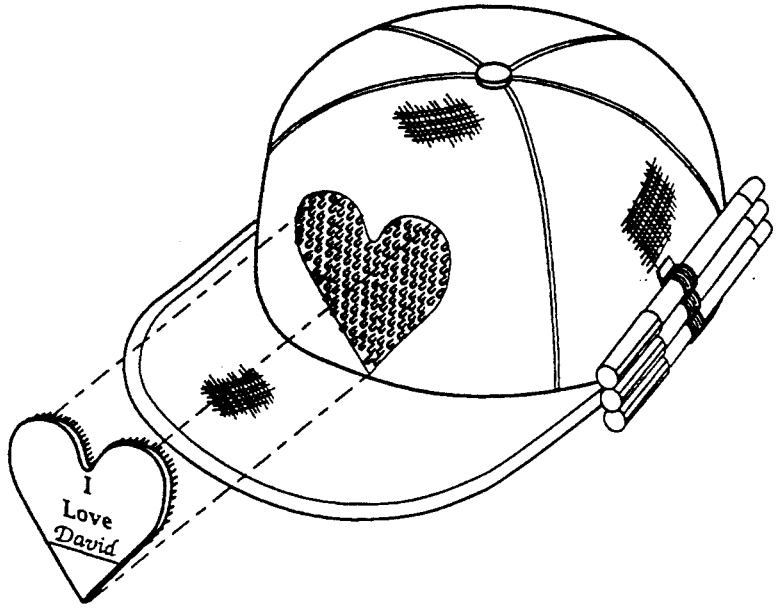
FIG. 7 depicts a side perspective view of another alternative embodiment of the present cap.

Referring again to FIGS. 1 and 2, the present cap 10 includes at least one writing surface or billboard 50. The writing surface 50 may be made of any suitable material that will erasably receive markings made by a nonpermanent, erasable marker, pen or other writing implement. The writing surface 50 can be sized and shaped as desired for a particular application. Here the writing surface 50 is shaped as a rounded-edge rectangle, but any imaginable shape will work equally as well. For instance, see FIGS. 7 and 8. It is anticipated that the size and shape of the writing surface will be dictated by the amount of writing or art work surface area that is desired to be included with the cap 10. The writing surface 50 has a front side 54 that forms the actual area on which the wearer can mark, and a second side 56 which is removably or permanently secured to the exterior of the crown 22.

The writing surface 50 may include an outer rim or frame 52 along its perimeter to provide a defined writing region for the cap 10. The frame 52 can be a plain, raised edge, such as in FIGS. 1 and 2, or a fanciful border with artistic designs, such as in FIG. 3. Actually, the frame can be made optional so that the writing surface 50 is completely flat, such as in FIG. 6. As shown throughout the several views the writing surface 50 is generally depicted as a separate portion, but it is contemplated that the writing surface 50 can be integrally formed or flush with the exterior surface 30 of the crown 22. Further, it is contemplated that more than one writing surface 50 can be utilized to provide various distinct writing surfaces 50 for the wearer of the cap 10.

Preferably, the writing surface 50 is permanently secured to the crown 22, such as by being sewn or adhered to the exterior surface 30 of the crown 22. It is also preferred that the writing surface 50 be secured to the front area or front panel 32 of the crown 22. FIG. 4 shows the writing surface 50 adhered to the front panel 32, as preferred. Alternative embodiments of the present writing surface 50 will be more fully described hereinafter.

Figure 1:
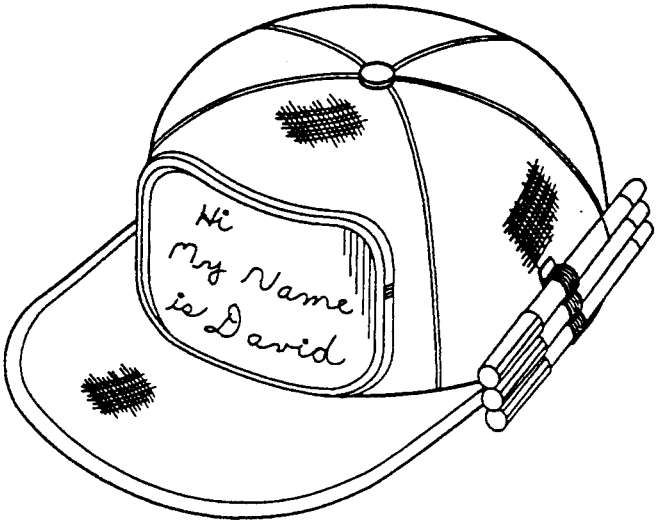
FIG. 1 depicts a perspective view of the present cap showing the writing implements attached to the cap and writing inscribed on the billboard.

Referring to FIG. 1, the present cap with erasable billboard 10 also includes at least one writing implement 60 used to inscribe a desired expression, design, image or message on the writing surface 50. Preferably, the wearer of the cap 10 will be provided with a choice of colors with which to mark writing surface 50. Accordingly, more than one writing implement 60, here three are used, will typically be included with the cap 10. The writing implements 60 can be generally available pens or markers that will not permanently mark the writing surface 50. To this end, it is important that the type of pen or markers chosen be tested with the material used to make the writing surface 50 to insure that the pen or marker will not permanently mark the writing surface. Likewise, it is vital to the invention that the ink or marking substance of the writing implements 60 be easily removable or erasable from the writing surface 50.

The writing implements 60 are secured to the crown 22 so that the wearer can easily retrieve a pen or marker to inscribe the desired expression or design on the writing surface 50. To provide easy storage and accessibility of the writing implements 60, a multi-loop pen holder 62 is utilized. The pen holder 62 is configured to hold a predetermined number of writing implements 60, here three for the three pens being used. Although the writing implements 60 can be secured anywhere on the cap 10, it is preferred that the writing implements 60 and the pen holder 62 are secured to one of the side panels 34 or 36 so that they are easily accessible, yet do not obstruct the writing surface 50 or the wearer's vision.

Referring to FIGS. 2 and 3, the cap 10 further includes an eraser 70 which is used to fully or partially remove the markings or inscriptions from the writing surface 50 once it is desired to change or edit what is being communicated. The eraser 70 will generally be a strip of material that is dimensioned to provide sufficient surface area to erase the markings from the writing surface 50. Accordingly, it is contemplated that the eraser 70 will generally be somewhat smaller than the writing surface 50. The eraser 70 is removably secured to the crown 22 so that, as with the writing implements 60, the wearer can easily access the eraser 70 to erase the markings from the writing surface 50.

Although a variety of fabric or fabric-like materials can be used to erase the markings, the material of choice is that used in a hook and loop fastening system, such as Velcro®. The looped portion of the hook and loop system works most effectively, and will not damage the writing surface 50. To a lesser degree, the material which comprises the hook portion of the hook and loop fastening system also works well to erase the markings from the writing surface 50. Thus, in the preferred version of this invention, the eraser actually comprises a strip of loop-like material, which is removably fastened to a second attachment strip 72 of the hook-like material of a hook and loop fastening system. The strip 72 is itself fixedly secured to the crown 22. Further, it is preferred that the eraser 70 and the corresponding attachment strip 72 be secured to the side 32 or 34, opposite the side 32 or 34 used to secure the writing implements 60 to the cap 10. However, it is anticipated that the eraser 70 can also be secured to other portions of the either the interior surface 28 or exterior surface 30 of the crown 22, as well as on visor 24. As discussed above, the eraser 70 is inherently, removably attached to the cap 10 because it is a strip of hook-like material, while the corresponding attachment strip 72 is the loop-like material of a hook and loop fastening system. Other materials that can be removably secured to the cap 10 may be substituted, but it is the inherent qualities of the hook-like material that makes it preferred.

A direct consequence of using the hook and loop fastening material is that the eraser 70 is not only used to erase the markings, but also provides an inherent securing assembly for securing the eraser 70 to the cap 10. By securing eraser 70 directly to the cap 10, the wearer can quickly and easily access the eraser 70 when it is desired that the markings on the writing surface 50 are due for a change. Referring to FIG. 1, the writing surface 50 has been marked with the phrase "Hi! My Name is David" using the writing implements 60. Of course, the wearer can mark the writing surface 50 with any desired lettering, symbols, phrases, art work, etc. For the wearer's safety, it is recommended that the markings not communicate expressions that a viewer might take strong exception to. Once marked with the desired expression, the writing surface 50 can be fully or partially erased using eraser 70, such as shown in FIG. 2. In this way, the wearer can create a personalized billboard to communicate a desired message or expression, and subsequently change it quickly and easily, while repeatedly using the cap 10. For example, the wearer may write "Go Bears!" at the beginning of a football game, and then decide to mark the cap 10 with "Go Packers!!," once the game takes an unexpected turn in the score.

Figure 6:
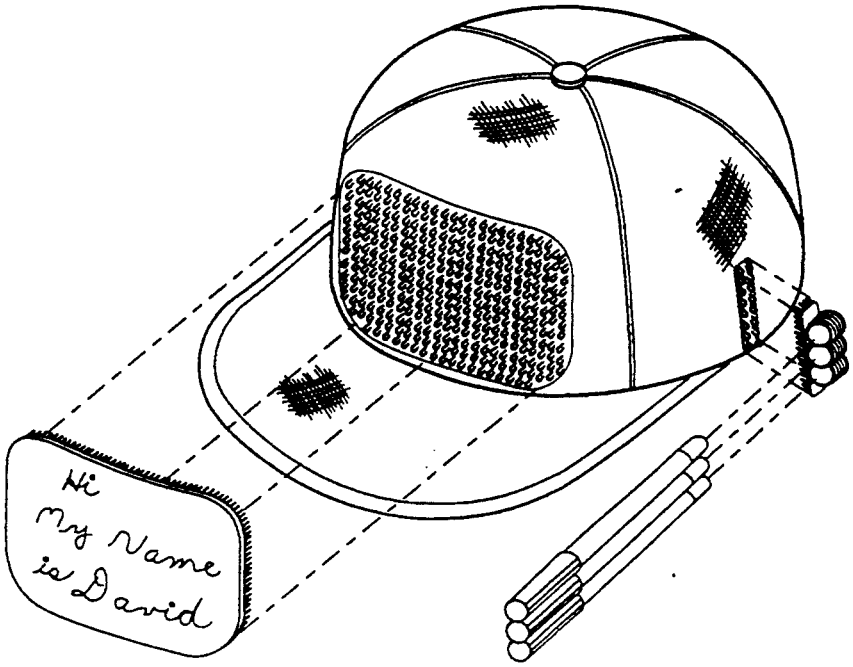
FIG. 6 depicts another alternative embodiment of the present cap wherein the billboard is removably attached to the cap.

Referring now to FIGS. 3 and 6, there is shown various alternative features of the present cap with an erasable billboard 10. Preferably, the writing surface 50 will be adhered to the front panel 32 of the crown 22, such as shown in FIG. 3, to prevent the writing surface 50 from becoming inadvertently detached, lost or damaged. However, as shown in FIGS. 3 and 6, to increase the adaptability of the cap 10, it should be understood that all of the components of the cap 10 can be removably secured to the crown 22. Thus, the writing surface 50, the writing implements 60 and the eraser 70 can all be removably attached to portions of the crown 22 or visor 24.

As shown in FIG. 6, the writing surface 50 is shown removably attached to the crown 22 with a loop and hook fastening system, such as Velcro®. Typically, the crown 22 will have permanently attached to its exterior surface 30 a strip or sheet of hook or loop fastening material 74, depending on whether the second side 54 of the writing surface 50 has hooks or loops to effectuate the fastening engagement. It is also contemplated that the entire crown 22, an entire panel 32, 34, 36, 38 or 40, or a portion of a panel, can be made of the appropriate hook or loop material to effectuate the releasable attachment of the writing surface 50, or other components, to the crown 22.

Also, shown in FIG. 3 is the multi-loop pen holder 62 detached from the crown 22 and having the writing implements 60 removed from the holder 62. The eraser 70 and the attachment strip 72 are also shown detached from the crown 22. In FIG. 6 the pen holder 62 is shown using a hoop and loop fastening system, such as Velcro®, to provide for a removably secured pen holder 62.

Figure 5:
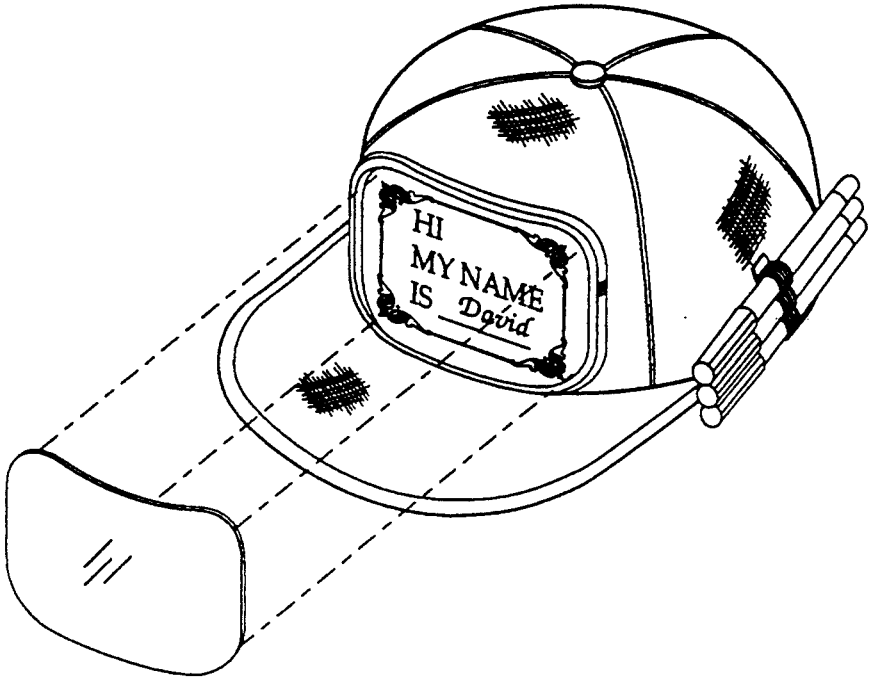
FIG. 5 depicts a side perspective view of the present cap with an alternative billboard and the protective cover exploded from the present cap.

Turning to FIG. 5, the cap 10 can also be provided with a peelable, protective sheet 76, which is dimensioned to substantially cover and protect the markings made on the writing surface 50. It is preferred that the sheet 76 be self-adhered to the first side 52 of the writing surface 50, such as by using a material which naturally clings or is statically attracted to the material used as the first side 54 of the writing surface 50. Although it is the impermanence of the markings that the invention is primarily directed to, the wearer may wish to protect the markings from inadvertent erasure or smudging. The user may have expended considerable time and effort in expressing a particular idea or in designing a unique figure. Hence, it may be desirable to save and protect the markings, at least for a short time. Accordingly, the sheet 76 is intended to provide the wearer of cap 10 with a simple way to protect the markings until the wearer intends to erase them.

Also in FIG. 5 there is shown another optional feature of the writing surface 50, wherein the writing surface 50 includes permanent, preprinted matter on its first side 54. The permanent, preprinted matter can be a stylistic boarder 78, a partial phrase 80 to be completed by the wearer, a familiar cartoon character with fill-in sections, sports teams, etc. The wearer can still add their own erasable markings to the writing surface 50 to individualize the cap 10. This feature is especially applicable to caps that are used repeatedly for the same purpose by different people. For example, the common "Hello, My Name is:" name tag which is unfortunately very popular at many social functions and business related events. In FIG. 5, the wearer completes the phrase by inscribing a name. Subsequently, the name can be erased with eraser 70 and the writing surface 50 provided with a new name using writing implements 60, which are both conveniently located on the cap 10.

Figure 8:
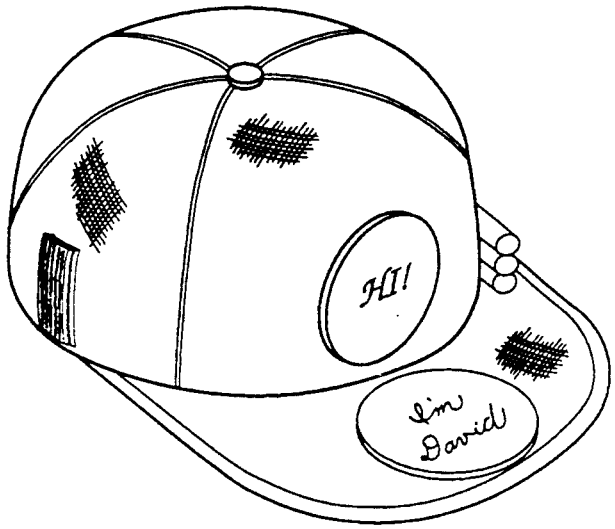
FIG. 8 depicts yet another alternative embodiment of the present cap.

Earlier it was stated that the writing surface 50 may be configured in an endless array of sizes and shapes. Accordingly, in FIG, 7 there is shown writing surface 82 shaped in the form of a heart. The cap 10 can include more than one writing surface 50, such as writing surfaces 84 and 86, as depicted in FIG. 8. In this embodiment, either one or both of the circular writing surfaces 84 or 86 may be permanently or removably attached to the crown 22 as with writing surface 50. As shown, writing surfaces 84 and 86 are permanently secured. Likewise, either one or both of the writing surfaces 84 or 86 can include permanent, preprinted matter. As shown, the writing surface 86 is located on the visor 24, but it is contemplated that the writing surface 86 or more writing surfaces can be permanently or removably secured to the crown 22.

If the crown 22 is provided with hook and loop fastening material, then the wearer can interchange the specific writing surfaces 50, 82, 84 or 86 used, as well as to change the markings to create entirely new expressions or designs. Thus, the cap 10 can be provided with numerous types of writing surfaces so that the user can easily adapt the cap for new uses. It will be appreciated that the specific arrangement of the writing surface 50, the writing implements 60 and the eraser 70 can be varied while keeping with the principals disclosed herein. Although the present invention has been herein shown and described in conjunction with an ordinary baseball type cap, the arrangement of the writing surface 50, writing implements 60 and an eraser 70 to other articles of clothing is also contemplated.

In using the present cap with an erasable billboard 10, the user simply removes the selected writing implements 60 from the holder 62 and marks the writing surface 50 with the desired words, symbols or other markings. If the protective sheet 76 is included, the user would first peel off the sheet 76, then mark the writing surface 50 as desired, and then reapply the sheet 76 to cover and protect the markings until it is determined by the wearer that the markings should be erased. The wearer can return the writing implements 60 to holder 62 and on the cap 10 until it is desired to mark the writing surface 50 once again.

If the wearer decides to partially or fully erase the markings on the writing surface 50, the eraser 70 can be detached from the cap 10 and drawn across the first side of the writing surface 50 until the marking is properly erased. Once erasure is completed, the user can return the eraser back onto the cap 10. Thus, instead of throwing the cap 10 away or wastefully using it as a painter's cap or such, the wearer can repeatedly change the cap 10 to express a particular message or idea. The cap 10 includes all the necessary implements: a writing surface 50, marking pens 60, and an eraser 70, to allow the wearer to change the cap 10 quickly and easily. Essentially, the cap I0 carries, as a unit, all the necessary instruments for individualizing and customizing the message communicated by the cap 10.

While various embodiments of the present cap with erasable billboard 10 have been shown and described, it should be understood that various other alternatives, substitutions and equivalents can be used, and that the present invention should only be limited by the claims and equivalents thereof. Therefore, the terms and expressions serve only to describe the invention by example only and not to limit the invention. It is expected that others will perceive difference which, while differing from the foregoing, do not depart from the spirit and scope of the invention herein described and claimed.

Various features of the present invention are set forth in the following claims.

What I claim is:

1. A cap comprising:

a crown portion having at least a front panel, a rear panel opposing said front panel, a first side panel and a second side panel opposing said first side panel, said panels configured and arranged so as to form a substantially unitary interior surface and an exterior surface for said crown portion;

at least one writing surface, said writing surface having a first side and a second side, said first side configured to erasably receive writing thereon, and said second side of said writing surface for attachment to said exterior surface of said crown;

means for erasably marking said writing surface to communicate a desired expression or design inscribed by a user, said marking means being removably attached to said crown portion; and means for erasably marking said writing surface to communicate a desired expression or design inscribed by a user, said marking means being removably attached to said crown portion; and an eraser being formed of a first strip of material having a first surface which consists of a multitude of loops and a second surface consisting of a multitude of hooks, said first or said second surface being releasably, matingly attachable to a second strip of material which consists of a plurality of hooks or loops, said second strip being fixedly secured to said exterior surface of said crown portion, said eraser utilizing said hooks of said first surface of said first strip or said loops of said second surface of said first strip to erase said expression or design when said eraser is drawn across said writing surface.

2. The cap as described in claim 1, wherein said marking means comprises at least one marking pen.

3. The cap as described in claim 2 further including a pen holder for storing said marking pen on one of said sides of said exterior surface of said crown portion.

4. The cap as described in claim 1 wherein said writing surface includes permanent, preprinted matter on said first side of said writing surface.

5. The cap as described in claim 1 wherein said writing surface is removably attached to said exterior surface of said crown portion.

6. The cap as described in claim 1 further including means for protecting said expression or design produced with said marking means from inadvertent erasure, said protective means being easily attached and removed from said first side of said writing surface.

* * * * *